US006865365B2

(12) United States Patent
Kim et al.

(10) Patent No.: US 6,865,365 B2
(45) Date of Patent: Mar. 8, 2005

(54) HEATING ROLLER OF A FIXING APPARATUS AND METHOD FOR MANUFACTURING AN ELECTRODE FOR USE WITH THE SAME

(75) Inventors: Hwan-guem Kim, Seoul (KR); Durk-hyun Cho, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/412,276

(22) Filed: Apr. 14, 2003

(65) Prior Publication Data

US 2004/0047660 A1 Mar. 11, 2004

(30) Foreign Application Priority Data

Sep. 6, 2002 (KR) ..... 2002-53766

(51) Int. Cl.[7] ..... G03G 15/20
(52) U.S. Cl. ..... 399/330; 219/216
(58) Field of Search ..... 399/320, 328, 399/330, 332, 333, 334; 219/216

(56) References Cited

U.S. PATENT DOCUMENTS 5,737,664 A * 4/1998 Fukuda et al. ..... 399/33
5,765,075 A * 6/1998 Yamamoto ..... 399/69
6,615,006 B2 * 9/2003 Michlin et al. ..... 399/90

FOREIGN PATENT DOCUMENTS

JP 62-286079 * 12/1987
JP 3-144681 * 6/1991

* cited by examiner

*Primary Examiner*—Hoan Tran
(74) *Attorney, Agent, or Firm*—Roylance, Abrams, Berdo & Goodman, L.L.P.

(57) ABSTRACT

A heating roller of a fixing apparatus capable of blocking power to a heating roller when temperature rises over a predetermined temperature. The heating roller includes an OFC pipe, a heating coil disposed to cover an outer circumference of OFC pipe, an aluminum pipe covering an outer circumference of heating coil, an insulator to cover a surface of heating coil and separate the heating coil from contact with OFC pipe and aluminum pipe, and an electrode installed at both ends of the aluminum pipe and having a terminal in electrical contact with the heating coil that melts when its temperature rises above a predetermined temperature. The terminal can be removed from the heating coil in the event such melting occurs. The heating roller further includes a brush which contacts an outside surface of the electrode to provide AC power to the electrode. Accordingly, when the temperature of the heating coil rises above a predetermined temperature, the terminal of the electrode melts and thus discontinues the supply of AC power from the brush to the heating coil. Terminal includes a base protruded from electrode, a melting portion continued to base, and a connection connected with heating coil and continued to melting portion, and when temperature of heating coil rises over predetermined temperature, melting portion is melted and supply of AC power transmitted to heating coil is cut off.

21 Claims, 5 Drawing Sheets

HEATING ROLLER OF A FIXING APPARATUS AND METHOD FOR MANUFACTURING AN ELECTRODE FOR USE WITH THE SAME

This application claims benefit under 35 U.S.C. § 119 from Korean Patent Application No. 2002-53766, filed on Sep. 6, 2002, the entire content of which is incorporated herein by reference.

BACKGROUND OF THE INVENTION

1. Field of the Invention

The present invention relates to a fixing apparatus for fixing a transferred image onto a sheet of paper. More particularly, the present invention relates to a heating roller of a fixing apparatus, which is capable of blocking power being supplied to the fixing apparatus when a temperature of the fixing apparatus increases to more than a predetermined temperature, and a method for manufacturing an electrode for use with the same.

2. Description of the Related Art

Generally, a fixing apparatus fixes an image transferred from a photosensitive medium onto a sheet of paper with heat generated by a heating roller and pressure applied by a pressing roller. The heating roller typically includes a halogen lamp, a heating coil, and a resistance heating element or the like which acts as a heat source.

FIG. 1 is a view showing an example of a fixing apparatus having a heating roller 80 which generates heat by using a heating coil. Referring to FIG. 1, the heating roller 80 includes an aluminum pipe 10, insulators 20, heating coils 30, an OFC (Oxygen Free Copper) pipe 50, electrodes 40, brushes 45 and a thermostat 60.

The aluminum pipe 10 forms the outer surface of the heating roller 80, and is manufactured from aluminum that has high heat conductivity. Both ends of the aluminum pipe 10 are supported by bearings 15. Moreover, the surface of the aluminum pipe 10 is typically a Teflon coated layer 12 in order to have non-stick properties with respect to a toner.

The insulators 20 insulate the heating coils 30 in the aluminum pipes 10 from the aluminum pipe 10 and the OFC pipe 50, and comprise external layer insulators 22 to insulate the heating coils 30 and the aluminum pipe 10 and internal layer insulators 24 to insulate the heating coils 30 and the OFC pipe 50. The external layer insulators 22 and internal layer insulators 24 are generally made of mica or some other suitable material.

The OFC pipe 50 is made of OFC having high heat conductivity, and contains a working fluid 52. Both ends of the OFC pipe 50 are closed.

The electrodes 40 are installed at both ends of the aluminum pipe 10, and connected to the heating coils 30. The brushes 45 are connected to an outer circumference of the electrodes 40 so that AC (alternating current) power can be supplied to the electrodes 40 even when the heating roller 80 is rotated. The brushes 45 are further connected to an AC control 70, and the thermostat 60 is connected to an electric wire connecting the brushes 45 and the AC control 70. The thermostat 60 operates to block power being supplied to the fixing apparatus when the surface temperature of the aluminum pipe 10 rises to more than a predetermined temperature, and is installed at an appropriate place for measuring the surface temperature of the aluminum pipe 10. In this example, the thermostat 60 is secured with a bolt (not shown) to an injection molded polymer frame that wraps the fixing apparatus.

In addition, a pressing roller 90 that rotates and presses against the aluminum pipe 10 is installed below the heating roller 80 as shown.

The process of heating the heating roller 80 having the above structure will now be described.

When the electrical power is supplied from the AC control 70, AC power is supplied to the brushes 45. After the power is supplied to the brushes 45, the power is transmitted to the electrodes 40 installed at both ends of the aluminum pipe 10, and the power transmitted to the electrodes 40 is provided to the heating coils 30 so that heat is generated by the heating coils 30.

Some of the heat generated by the heating coils 30 is transmitted to the aluminum pipe 10 and heats its surface, and rest of the heat is transmitted to the OFC pipe 50. The heat transmitted to the OFC pipe 50 rapidly gasifies the working fluid 52 in the OFC pipe 50 due to the high heat conductivity of OFC. After the working fluid 52 in the OFC pipe 50 is completely turned to saturated vapor, the heat generated at the heating coil 30 is all or substantially all transmitted to the surface of the aluminum pipe 10 and used to settle a toner and increase the temperature of a sheet of paper.

As described so far, when the OFC pipe 50 is used, an image can be instantly fixed as temperature increases by 10° C. per second. In addition, the OFC pipe 50 can rapidly raise the efficiency in which the temperature is increased due to the saturated vapor of the working fluid 52 contained inside, and also prevents the temperature of the aluminum pipe 10 from being rapidly cooled after printing. Thus, power need only be supplied to the heating coil 30 at a frequency of two or three times per sheet of paper. Therefore, power consumption for printing is less than that consumed by an apparatus whose heating roller is heated by a halogen lamp.

When the AC power is not normally controlled with respect to the heating coil 30 due to, for example, malfunction of the AC control 70, the heating coil 30 is constantly heated, and the surface temperature of the aluminum pipe 10 increases. In this event, a bimetal switch of the thermostat 60 that is installed separate from the surface of the aluminum pipe 10 operates to block the AC power. Then, the heating roller 80 can cool when power is not supplied to the heating coil 30 of the heating roller 80.

In other words, if the AC control 70 that controls the supply of AC power malfunctions due to, for example, a malfunction of the CPU of the fixing apparatus. Also, if a photo triac that controls the on/off switching of the AC power supplied to the heating coil 30 of the heating roller in accordance with a control signal from the CPU malfunctions and thus causes an "On" signal to be continuously transmitted to the heating coil 30 even when the CPU outputs an "Off" control signal, the thermostat 60 should sense the rise in the surface temperature of the aluminum pipe 10 and block the AC power being provided to the heating coil 30.

However, the injection molded polymer frame having the thermostat 60 tends to become bent or misformed. Therefore, it is sometimes difficult to maintain the appropriate distance between the thermostat 60 and the heating roller 80. When the distance between the thermostat 60 and the heating roller 80 is not consistent, the surface temperature of the heating roller 80 may not be accurately detected by the thermostat. In other words, due to these variations from unit to unit, the temperature at which the thermostat 60 blocks the AC power being supplied to the heating coil 30 is not consistent for each unit produced. When the thermostat 60 operates too late because the distance between the thermostat 60 and the heating roller 80 is too large, the heating roller 80, the pressing roller 90, and frame of the fixing apparatus might become melted or give off fumes. Thus, the possibility of fire can increase, and a user might experience some anxiety.

In an attempt to avoid the above problems, a thermostat that contacts the surface of the heating roller 80 can be used. However, this type of sensor can cause abrasion and breakage of the Teflon coated layer 12 on the surface of the aluminum pipe 10 of the heating roller 80.

SUMMARY OF THE INVENTION

An object of the present invention is to overcome the above-mentioned problems associated with the conventional apparatus. Accordingly, it is the object of the present invention to provide a heating roller of a fixing apparatus that is capable of automatically blocking AC power being supplied to a heating coil when the heating coil rises over a predetermined temperature without using a thermostat.

Moreover, another object of the present invention is to provide a method of manufacturing an electrode used for the above heating roller.

These and other objects of the present invention are substantially achieved by providing a heating roller of a fixing apparatus, comprising an OFC pipe, a heating coil disposed to cover an outer circumference of the OFC pipe, an aluminum pipe covering an outer circumference of the heating coil, an insulator that covers a surface of the heating coil and thus separates the heating coil from the OFC pipe and the aluminum pipe, an electrode installed at both ends of the aluminum pipe that has a terminal which contacts the heating coil and melts when the temperature rises above a predetermined temperature; and a brush that contacts the electrode and provides AC power to the electrode. When temperature of the heating coil rises above the predetermined temperature, the terminal of the electrode melts and thus discontinues the supply of AC power from the brush to the heating coil.

In this example, the terminal includes a base protruding from the electrode, a melting portion connected to the base, and a connection that connects the heating coil to the melting portion. When temperature of the heating coil rises above the predetermined temperature, the melting portion melts and discontinues the supply of the AC power to the heating coil. The terminal can have the shape of a thin belt, and can have a melting temperature between 250° C. to 300° C. Moreover, the connection and the heating coil are separated.

A method of manufacturing an electrode of a heating roller according to an embodiment of the present invention comprises the steps of: shaping an electrode having a thin belt shaped terminal, creating a hole at the center or substantially at the center of the terminal, depositing a melting material, which melts at a predetermined temperature below a melting temperature of the terminal, into the hole; and cutting the terminal around the hole having the deposited melting material.

The terminal hole can be formed using an etching process. Furthermore, the step of depositing the melting material into the hole can include the steps of manufacturing a mold that makes it possible to evenly deposit the melting material into the terminal hole so that the material has the same thickness as the terminal, cleaning around the terminal hole with a cleaning agent and positioning the terminal hole at an appropriate location with respect to the mold, melting the melting material; pouring the melted melting material into the mold, and separating the terminal from the mold when the terminal cools.

Another method of manufacturing an electrode for use with a heating roller according to an embodiment of the present invention comprises the steps of shaping an electrode having a terminal, cutting the terminal, and connecting the remaining portion of the terminal and the portion of the terminal that has been cut away using a thermal fuse.

As can be appreciated from the above, the heating roller of a fixing apparatus according to an embodiment of the present invention includes a terminal of an electrode that melts and thus discontinues the supply of AC power when the heating coil becomes overheated due to an abnormal condition of an AC control device. Thus, no thermostat needs to be used as in the conventional apparatus. In addition, a method of manufacturing an electrode of a heating roller according to an embodiment of the present invention enables an electrode having a meltable terminal to be easily manufactured.

BRIEF DESCRIPTION OF THE DRAWINGS

The above-mentioned objects and features of the present invention will be more apparent by describing several embodiments of the present invention with reference to the appended drawings, in which.

DETAILED DESCRIPTION OF THE PREFERRED EMBODIMENTS

Exemplary embodiments of the present invention will now be described in greater detail with reference to the appended drawings.

Figure 1:
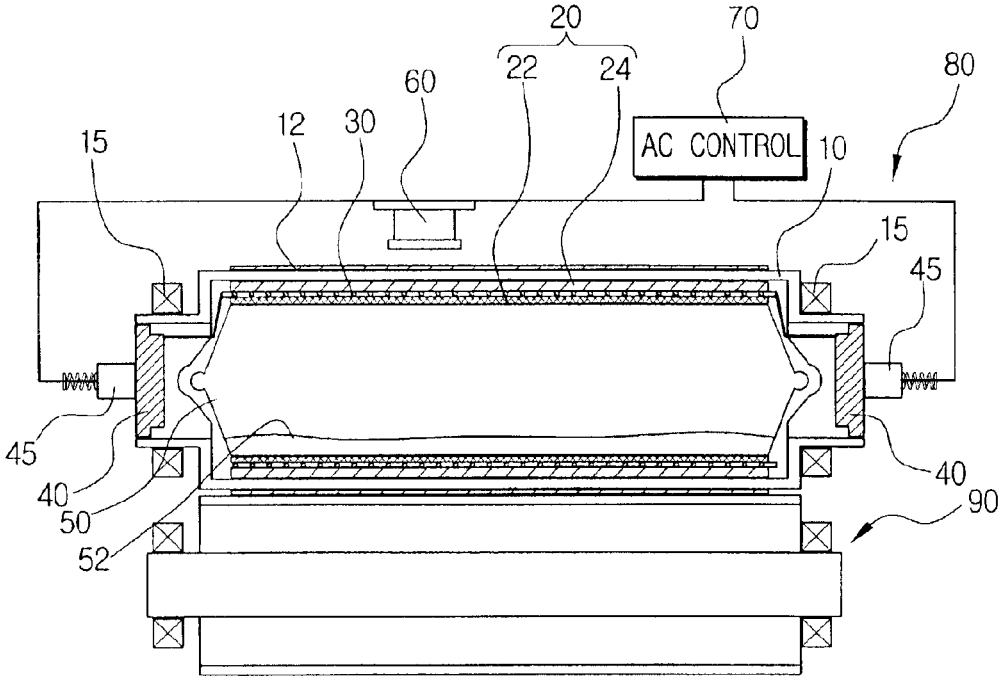
FIG. 1 (PRIOR ART)
FIG. 1 is a cross-sectional view showing an example of a conventional fixing apparatus.
Figure 2:
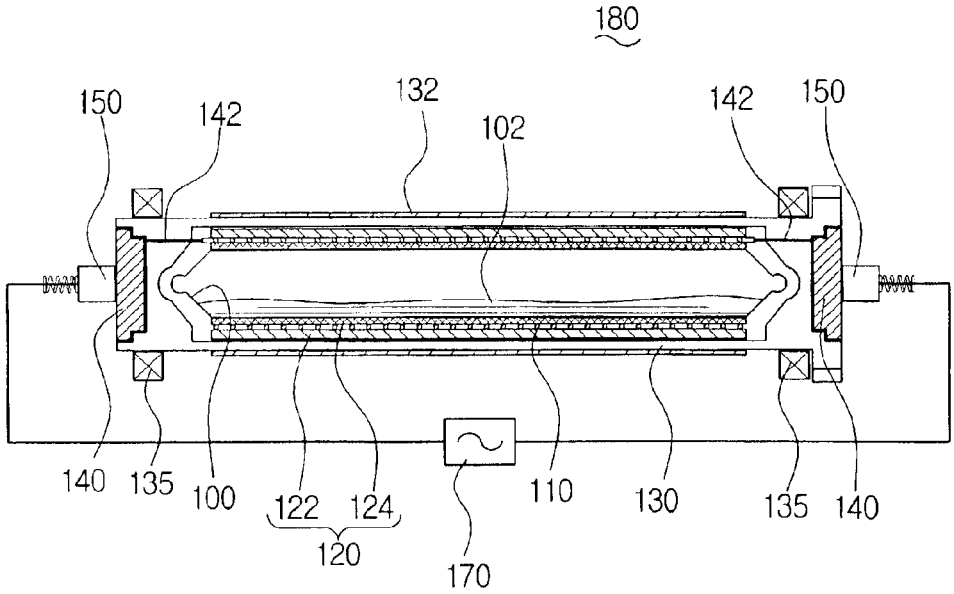
FIG. 2 is a cross-sectional view showing an example of a heating roller of a fixing apparatus according to an embodiment of the present invention.
Figure 3:
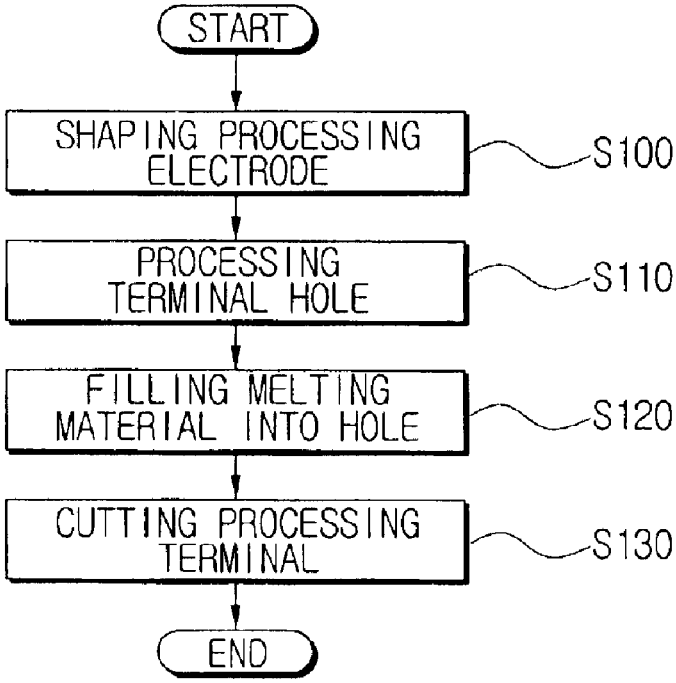
FIG. 3 is a flow chart showing an example of operations performed by a method for manufacturing an electrode of the heating roller shown in FIG. 2 according to an embodiment of the present invention.

Referring to FIG. 2, a heating roller 180 according to an embodiment of the present invention includes a OFC pipe 100, insulators 120, heating coils 110, aluminum pipe 130, electrodes 140, and brushes 150. The OFC pipe 100 is made of OFC having high heat conductivity, and contains working fluid 102 that is gasified when temperature rises to a certain degree. Both ends of the OFC pipe 100 are closed.

The insulators 120 insulate the heating coils 110 that are assembled at an outer circumference of the OFC pipe 100 from the OFC pipe 100 and the aluminum pipes 130. The insulators 120 comprise an inner layer insulator 124 to insulate the heating coils 110 from the OFC pipe 100 and an external insulator 122 to insulate the aluminum pipe 130 from the heating coils 110. The external layer insulator 122 and the inner layer insulator 124 are made of mica or any other suitable insulating material.

The heating coils 110 are formed of a material that can generate sufficient heat required to fix an image onto a sheet of paper when AC power is supplied. Both ends of the heating coils 110 can have a shape which allows for easily installation and separation of terminals 142 of the electrodes 140.

The aluminum pipe 130 forms an outer surface of the heating roller 180 and is made of aluminum having high heat conductivity. Both ends of the aluminum pipe 130 are supported by bearings 135. Moreover, the surface of the aluminum pipe 130 has a Teflon coated layer 132 having non-stick properties with respect to a toner.

Figure 4:
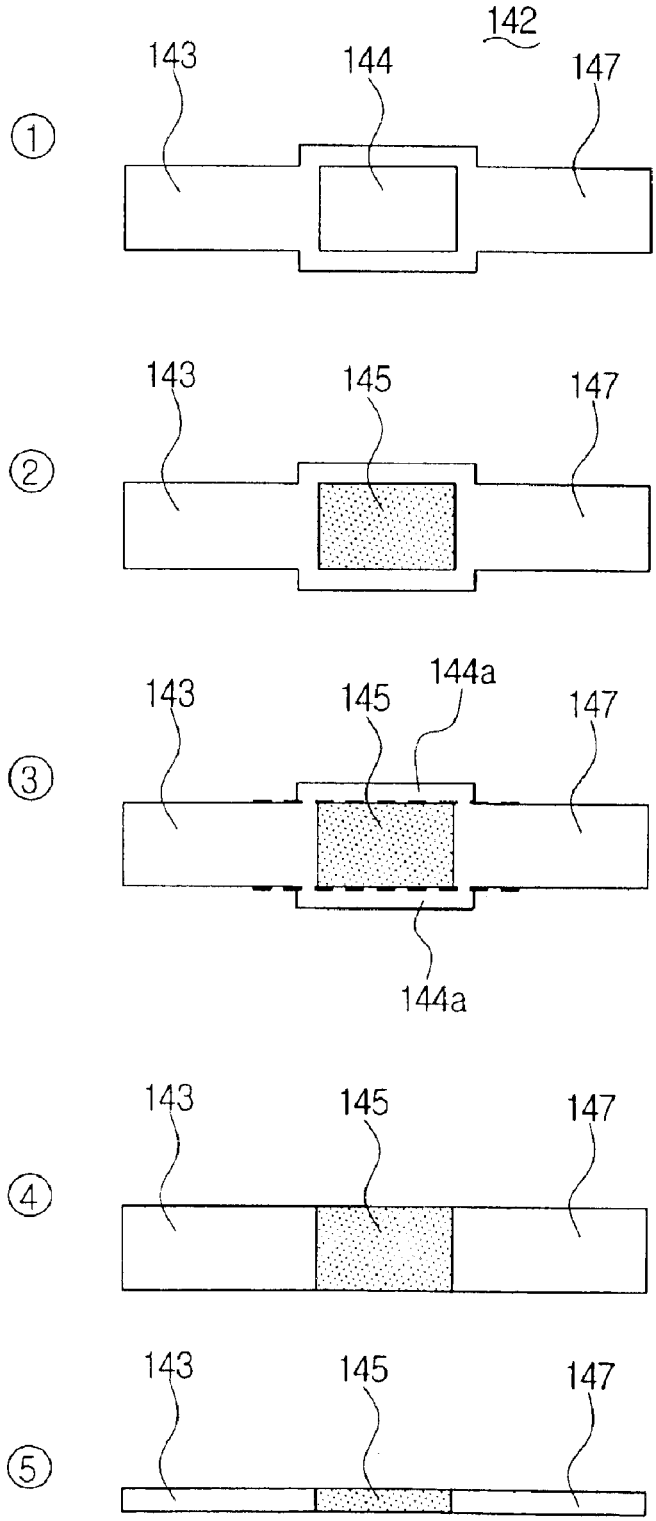
FIG. 4 presents views showing examples of the shape of a terminal of the electrode for each step in the method for manufacturing performed in FIG. 3.

The electrodes 140 are installed at both ends of the aluminum pipe 130, and have the terminals 142 connected to the heating coil 110. The terminals 142 have a shape that enable them to be easily connected to an end of the heating coils 110 installed inside the aluminum pipe 130. The terminals 142 can be formed as a thin belt as shown in FIG. 4 in order to be easily manufactured as described in more detail below. The terminals 142 include a base 143 protruding from the electrodes 140, a melting portion 145 extending from the base 143, and a connection 147 extending from the melting portion 145. The base 143 and the connection 147 are made of similar materials, such as phosphor bronze, phosphorous OFC or any other suitable material. Specifically, the melting portion 145 is made of a material having a melting point greater than a normal fixing temperature, but which enables the material to melt when an abnormal situation occurs and the temperature of the heating coils 110 increases to above a desired temperature, while also being low enough to avoid damage to the heating roller 180 and a surrounding frame (not shown). In addition, the material forming the melting portion 145 can be formed with the same shape as the terminals 142. Moreover, the material of the melting portion 145 can have adhesive properties in order to be firmly adhered to the base 143 and the connection 147. Therefore, soft solder that melts between 250 to 300° C., which is a temperature range above the normal usage limitation of the heating roller 180, is frequently used as the melting material. Generally, an alloy of Sn 53~60% and Pb, a Cd—Zn alloy having a melting point of 185~220° C., and a high Pb alloy having a melting point of 270~310° C., can be used as the melting portion 145 of the terminals 142.

An example of a method for manufacturing the electrodes 140 having the above terminals 142 according to an embodiment of the present invention will now be described with reference to FIGS. 3 to 6.

To begin, the electrodes 140 having the thin-belt shaped terminals 142 discussed above are formed by a powder sintering or molding technique, or by any other suitable technique, in step S100. When the electrodes 140 having the terminals 142 are formed, a square hole 144 is formed at the center or substantially at the center of the terminals 142 as shown in FIG. 4(1) through the use of an etching or punching process, or any other suitable process, in step S110. It is noted that the hole need not necessarily be square-shaped, but rather, can have any suitable shape. Then, a melting material 145, which melts at a predetermined temperature lower than the melting temperature of the terminals 142, is deposited into the square hole 144 in step S120.

Various techniques for depositing the melting material 145 into the hole 144 of the terminals 142 can be used. In one example a mold can be use as will now be described. Specifically, the mold is configured to enable the melting material 145 to be evenly deposited into the hole 144 at the same thickness of the terminals 142. Then, the region around the hole 144 into which the melting material 145 has been deposited is cleaned with a cleaning agent and assembled to the mold. Afterward, the melting material 145 is melted and is poured into the mold so that the hole 144 is filled or substantially filled with the melting material 145. When the melting material 145 solidifies, the terminals 142 are separated from the mold, resulting in electrodes 140 having the terminals 142 shown in FIG. 4(2) The terminals 142 having the melting material 145 in their hole 144 are put on a press, and the region 144*a* of the terminals 142 is cut away as shown in FIG. 4(3) in step S130. Then, electrodes 140 having the melting material 145 in the middle of the terminals 142 as shown in FIG. 4(4) can be formed. FIG. 4(5) is a front view of the terminals 142 shown in FIG. 4(4).

Figure 5:
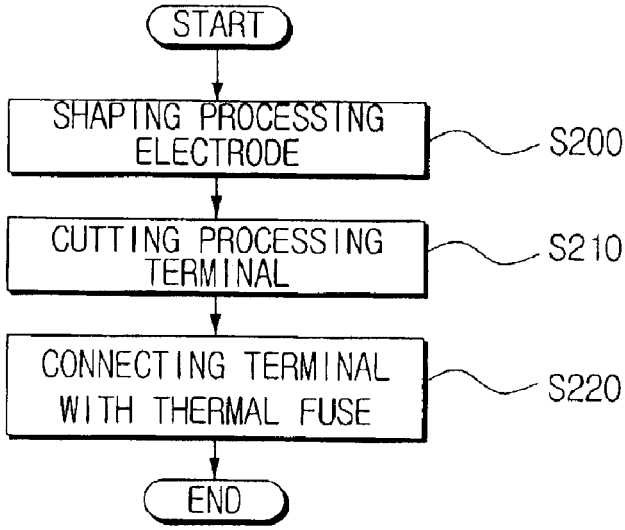
FIG. 5 is a flow chart showing an example of another method for manufacturing an electrode of the heating roller of FIG. 2 according to an embodiment of the present invention.
Figure 6A:
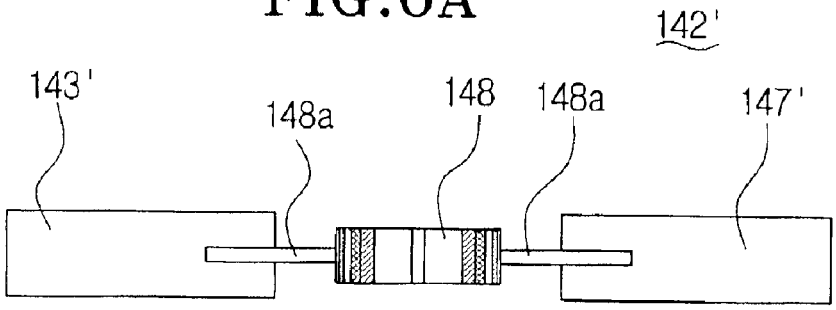
FIGS. 6A, 6B and 6C are a plane view, a front view and a side view, respectively, of an example of a terminal manufactured according to the method for manufacturing an electrode as shown in FIG. 5.
Figure 6B:
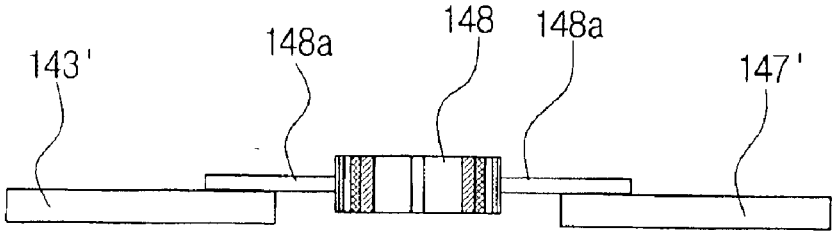
Figure 6C:
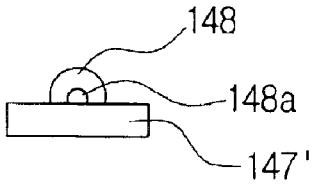

Another method of manufacturing the electrodes 140 having the terminals 142 is to first form electrodes 140 in step S200 of FIG. 5 to have terminals 142' shown in FIGS. 6A–C which are similar to terminals 142 discussed above. Then, the terminals 142' are cut using a press or any other suitable device in step S210. It is preferable that the center of the terminals 142' be cut. Afterward, a lower part 143' of the electrodes 140 and an upper part 147' are connected with a thermal fuse 148 as shown in FIG. 6A in step S220. At this time, a lead wire 148*a* of the thermal fuse 148 is joined to the upper part 143' and the lower part 147' of the terminals 142 by welding, pressing or any other suitable technique.

As discussed above, because the brushes 150 contact the outer surface of the electrodes 140, AC power can be provided to the electrodes 140 even when the aluminum pipe 130 is rotated. The brushes 150 are elastically supported by springs in order to remain in contact with the electrodes 140 and thus stably provide power to the electrodes 140 even when the electrodes 140 are rotated. The brushes 150 of both ends are individually connected to an AC control 170.

An example of the operation of the heating roller of a fixing apparatus having the above structure will now be further described with reference to the appended drawings.

When power is provided to the AC control 170, AC power is supplied to the brushes 150 coupled to the electrodes 140. When power is supplied to the brushes 150, the power is transmitted to the electrodes 140 installed at both ends of the aluminum pipe 130. The power transmitted to the electrodes 140 is supplied to the heating coils 110 through the base 143, melting portion 145 and connection 147 of the terminals 142, and heat is generated by the heating coils 110. Some of the heat generated from the heating coils 110 is transmitted to the aluminum pipe 130 to heat its surface, and rest of the heat is transmitted to the OFC pipe 100. The heat transmitted to the OFC pipe 100 gasifies the working fluid 102 in the OFC pipe 100 rapidly due to the high heat conductivity of the OFC. After the working fluid 102 in the OFC pipe 100 has completely or substantially completely turned to saturated vapor, the heat generated from the heating coils 110 is all or substantially all transmitted to the surface of the aluminum pipe 130 and used for settling the toner and raising the temperature of the sheet of paper to which the image is to be fixed.

As described above, as the AC power is provided to the heating coils 110 by the electrodes 140 having the terminals 142, the heating coils 110 are heated. Then, the surface temperature of the aluminum pipe 130 rises to 185° C. that is required to fix a transferred image onto the sheet of paper.

However, if the AC control 170 controlling the supply of AC power malfunctions due to, for example, a malfunction of the CPU of the apparatus, or a malfunction of a photo triac which controls the on/off switching of the AC power provided to the heating coils 110 of the heating roller as discussed above, then abnormal situations such as the continuous transmission of an "On" signal to the heating coils 110 may occur.

When the AC control 170 thus cannot properly control the supply of the AC power to the heating coils 110, the temperature of the heating coils 110 rises continuously. Therefore, when the temperature of the heating coils 110 rises over the melting temperature of the melting portion 145 of the terminals 142, the melting portion 145 melts. When the melting portion 145 melts, electrical contact between the electrodes 140 and the heating coils 110 is discontinued. For example, when the melting portion 145 is formed using melting material having a melting temperature of 250° C., the melting portion 145 melts and AC power being supplied to the heating coils 110 is discontinued when the temperature of the heating coils 110 rises to 250° C. Moreover, the terminals 142 can be removed from the ends of the heating roller 180 and the heating coils 110, so the melted electrodes 140 can easily be replaced with new electrodes 140 when the malfunction has been corrected.

According to the heating roller of a fixing apparatus according to the embodiments of the present invention described above, electrodes having terminals with an inserted melting portion are used. Therefore, when heating coils become overheated due to an abnormal condition, power can be accurately discontinued when the temperature of the heating coils reach the melting temperature of the melting portion. As can be appreciated from the above, because the melting portion is melted due to heat transmitted through a rapid conductive process, this technique is much more reliable than that of the conventional apparatus which employs a thermostat to discontinue the AC power.

Although several embodiments of the present invention have been described, it will be understood by those skilled in the art that the present invention should not be limited to the described embodiments, but rather, various changes and modifications can be made within the spirit and the scope of the present invention as defined by the following claims.

What is claimed is:

1. A heating roller adapted for use with a fixing apparatus, comprising:

an OFO pipe;

a heating coil disposed to cover at least a portion of an outer circumference of the OFC pipe;

an aluminum pipe covering at least a portion of an outer circumference of the heating coil;

an insulator, adapted to cover at least a portion of a surface of the heating coil, and to separate the heating coil from contact with the OFC pipe and the aluminum pipe;

at least one electrode having a terminal adapted to be in electrical contact with the heating coil and to melt when the temperature of said electrode rises over a predetermined temperature, and, wherein the terminal is further adapted to be removed from the heating coil in the event the terminal melts; and at least one brush, adapted to contact the electrode and provide AC power to the electrode, such that when the temperature of the heating coil rises over the predetermined temperature, the terminal of the electrode is melted and supply of the AC power from the brush to the heating coil is discontinued.

2. The heating roller as claimed in claim 1, wherein the terminal includes:

a base protruding from the electrode;

a melting portion coupled to the base; and a connection, adapted to couple the heating coil to the melting portion, such that when the temperature of the heating coil rises over the predetermined temperature, the melting portion melts and the supply of the AC power to the heating coil is discontinued.

3. The heating roller as claimed in claim 2, wherein the terminal has a shape of a thin belt.

4. The heating roller as claimed in claim 2, wherein the connection and the heating coil are separable.

5. The heating roller as claimed in claim 2, wherein the base and the connection each comprises at least one of phosphorous bronze and phosphorous Oxygen Free Copper (OFC).

6. The heating roller as claimed in claim 2, wherein the melting portion includes at least one of the following:

an alloy of Sn 53~60% and Pb, a Cd—Zn alloy having a melting point of 185~220° C., and a high Pb alloy having a melting point of270~310° C.

7. The heating roller as claimed in claim 1, wherein the melting temperature of the terminal is between at or about 250° C. to at or about 300° C.

8. The heating roller as claimed in claim 1, further comprising: two of said electrodes, each coupled to an opposite end of the aluminum pipe and to the heating coil; and two of said brushes, each adapted to contact a respective said electrode.

9. An electrode manufacturing method for a heating roller, the method comprising:

shaping an electrode having a thin belt shaped terminal;

forming a hole in the terminal;

depositing a melting material, which is adapted to melt at a predetermined temperature below a melting temperature of the terminal, into the hole; and cutting the terminal around the hole having the filled melting material.

10. The electrode manufacturing method as claimed in claim 9, wherein the forming employs an etching process to form the terminal hole.

11. The electrode manufacturing method according to claim 9, wherein the step of depositing the melting material comprises:

manufacturing a mold which is adapted to enable substantially even depositing of the melting material into the terminal hole so that a thickness of the melting material in the hole has substantially the same thickness as that of the terminal;

cleaning around of the terminal hole with a cleaning agent and assembling the terminal to the mold;

melting the melting material;

pouring the melted melting material into the mold; and separating the terminal from the mold when the terminal is cooled.

12. The electrode manufacturing method as claimed in claim 9, wherein:

the melting temperature of the melting material is between at or about 250° C. to at or about 300° C.

13. The electrode manufacturing method as claimed in claim 9, wherein the melting material includes at least one of the following:

an alloy of Sn 53~60% and Pb, a Cd—Zn alloy having a melting point of 185~220° C., and a high Pb alloy having a melting point of 270~310° C.

14. An electrode manufacturing method of a heating roller comprising the steps of:

shaping an electrode having a terminal;

cutting the terminal into first and second portions; and coupling the first and second portions of the terminal together using a thermal fuse.

15. The electrode manufacturing method as claimed in claim 14, wherein the coupling step includes performing a welding or pressing operation to couple the thermal fuse to the first and second portions of the terminal.

16. The electrode manufacturing method as claimed in claim 14, wherein:

the melting temperature of the thermal fuse is between at or about 250° C. to at or about 300° C.

17. The electrode manufacturing method as claimed in claim 14, wherein the thermal fuse includes at least one of the following:

an alloy of Sn 53~60% and Pb, a Cd—Zn alloy having a melting point of 185~220° C., and a high Pb alloy having a melting point of270~310° C.

18. A terminal, adapted for use with a heating roller, comprising:

a first portion, adapted to couple to an electrode of the heating roller and a second portion, adapted to couple to a beating coil of the heating roller;

a melting material, coupling the first and second portions together, and being adapted to melt at a predetermined temperature below a melting temperature of the terminal, such that when a temperature of the heating coil rises over a predetermined temperature, the melting material melts to uncouple the first and second portions and discontinue a supply of AC power from the electrode to the heating coil, and, wherein the terminal is further adapted to be removed from the heating coil in the event the terminal melts.

19. The terminal as claimed in claim 18, wherein:

the melting temperature of the melting material is between at or about 250° C. to at or about 300° C.

20. The terminal as claimed in claim 18, wherein the melting material includes at least one of the following:

an alloy of Sn 53~60% and Pb, a Cd—Zn alloy having a melting point of 185~220° C., and a high Pb alloy having a melting point of270~310° C.

21. A terminal as claimed in claim 18, wherein the melting material is configured as a thermal fuse.

* * * * *